United States Patent [19]

Balsiger

[11] 4,181,480

[45] Jan. 1, 1980

[54] ROTARY BLADE HYDRAULIC MOTOR WITH FLUID BEARING

[76] Inventor: Harold E. Balsiger, 26 W. Third St., Waynesboro, Pa. 17268

[21] Appl. No.: 825,297

[22] Filed: Aug. 17, 1977

[51] Int. Cl.[2] ..... F01C 1/00; F01C 21/02; F01C 21/04; F03C 3/00

[52] U.S. Cl. ..... 418/102; 418/230; 308/9

[58] Field of Search ..... 418/102, 228–232; 308/9

[56] References Cited

U.S. PATENT DOCUMENTS

| | | | |
|---|---|---|---|
| 1,236,399 | 8/1917 | Bowen, Jr. | 418/230 |
| 3,404,632 | 10/1968 | Reminiac et al. | 418/217 |
| 3,717,392 | 2/1973 | Ennis | 308/9 |
| 4,047,859 | 9/1977 | Sundberg | 418/232 |

FOREIGN PATENT DOCUMENTS

| | | | |
|---|---|---|---|
| 2319496 | 11/1974 | Fed. Rep. of Germany | 418/232 |

*Primary Examiner*—John J. Vrablik
*Attorney, Agent, or Firm*—Spencer T. Smith

[57] ABSTRACT

A hydraulic motor comprising a cylindrical rotor including a central bore, a cylindrical stator including selectively advanceable blade means, a stator having a central bore and first conduit means for directing pressurized fluid to the blade means, a drive shaft extending through the rotor central bore, the drive shaft including a full diameter portion secured to the rotor and a reduced diameter section extending from an axial location within the rotor member into the stator member central bore, a conical bearing secured to the drive shaft, a bearing track, a cylindrical sleeve member secured within the stator central bore and extending into the central bore to an axial location spaced from the full diameter drive shaft portion and establishing with the rotor central bore a first journal bearing, a segment of the reduced diameter drive shaft portion at the free end thereof establishing with a corresponding segment of the sleeve, a second journal bearing, the internal diameter of the remaining segment of the sleeve being enlarged to define with the corresponding segment of the reduced diameter portion an annular fluid cavity, second conduit means connecting the first conduit means and the cavity to establish a fluid bearing about the segment of the reduced diameter portion and to axially force the drive shaft conical bearing against the bearing track.

3 Claims, 3 Drawing Figures

ROTARY BLADE HYDRAULIC MOTOR WITH FLUID BEARING

The present invention relates to hydraulic motors or rotary displacement pumps.

Hydraulic motors or rotary displacement pumps such as are disclosed in U.S. Pat. No. 3,404,632, are operable at pressures beyond the design limits of conventional hydraulic motors. These motors are continuously balanced and operate smoothly and quietly.

Wear has a very substantial and deleterious effect on the performance of such hydraulic motors and, accordingly, wear must be minimized if the motor is to be successful.

It is accordingly an object of the present invention to provide a hydraulic motor or rotary displacement pump wherein wear will be minimized.

Additional objects and advantages of the present invention will become apparent from the following portion of this specification and from the accompanying drawings which illustrate, in accordance with the mandate of the patent statutes a presently preferred embodiment incorporating the principles of the invention.

Referring to the drawings.

Figure 1:
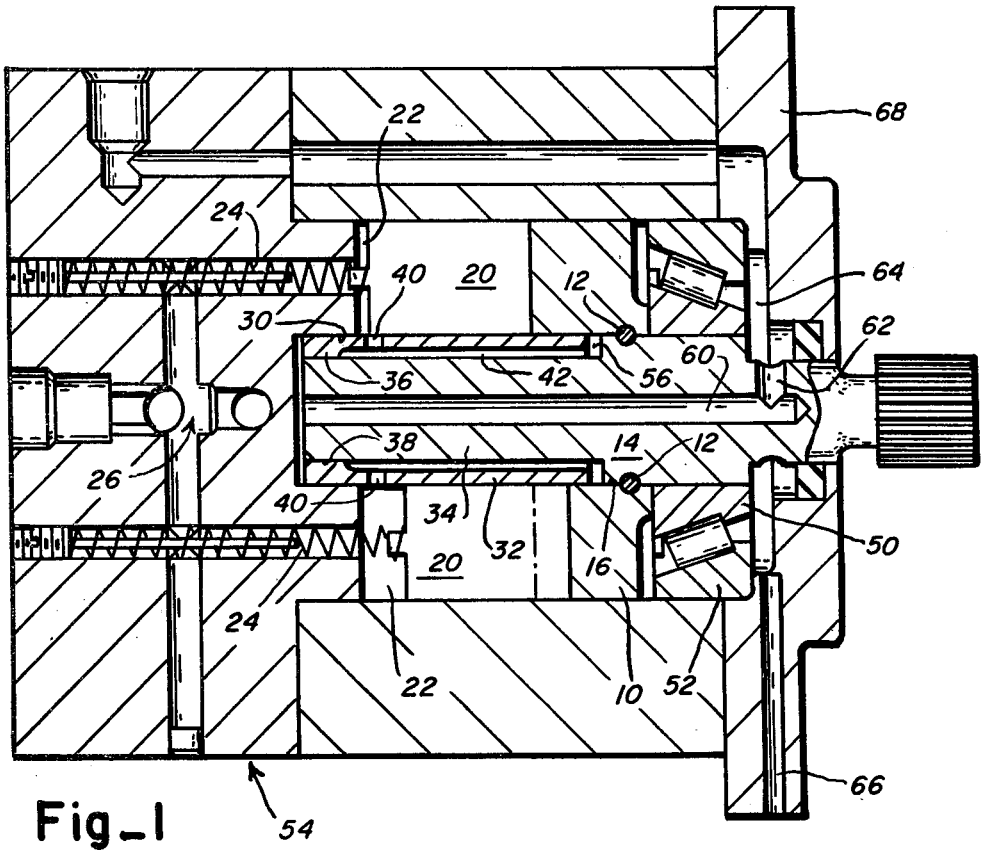
FIG. 1 is a cross-sectional view of a hydraulic motor made in accordance with the teachings of the present invention.
Figure 2:
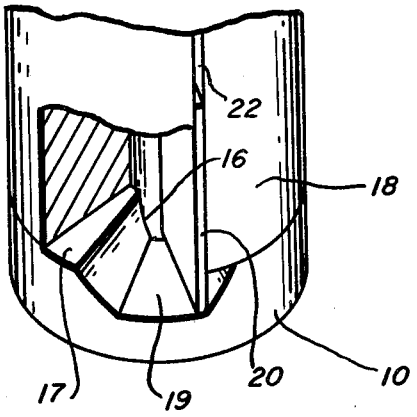
FIG. 2 is an oblique view, partly broken away of a portion of the hydraulic motor illustrated in FIG. 1.

The hydraulic motor includes a rotor member 10, which is secured by drive pins or keys 12 to a drive shaft 14 which passes through the central bore 16 of the rotor. Co-operating with the rotor member 10 is a stator member 18 which includes a plurality of blades or vanes 20, slidably displaceable in channels 22 and biased against the rotor by springs 24 and fluid pressure directed into the rear portion of the channels 22 from a control valve 26.

Secured by heat shrinking or the like within the stator member 18 central blind bore 30 is a cylindrical sleeve member 32, which concentrically surrounds a reduced diameter portion 34 of the drive shaft 14. This sleeve member extends axially into the rotor central bore 16 for mating engagement with a substantial axial portion of the rotor member.

The sleeve member 32 includes a journal section 36 at one end which rotatably supports a plain bearing 38 on the end of the reduced diameter shaft section 34. The journal bearing inhibits the passage of pressurized fluid, which is directed from the blade channels 22 through sleeve apertures 40, into an axial cavity 42, defined between the reduced diameter shaft portion 34 and the remaining axial portion of the sleeve from the journal section to the end proximate the rotor member 10 which has an enlarged internal diameter, from passing to the left or rear end of the reduced diameter shaft portion.

Secured to the drive shaft is a conical bearing 50 which rotatably engages a bearing track 52 maintained in the desired position by the motor housing 54.

Pressurized liquid which drives the motor is directed from one of the blade or vane channels 22 into the axial cavity 42, and this pressure acts radially on the reduced diameter section 34 to precisely center the drive shaft. This pressure conjointly acts on the face 56 of the enlarged diameter shaft section which is axially spaced from the sleeve member to provide an annular surface against which the pressure can axially act to force the conical bearing 50 into a precise relationship with the track 52 to also properly center the drive shaft.

A central bore 60 is defined in the drive shaft extending from the reduced diameter end to a location where it communicates with a diametral bore 62. Any liquid which passes between the plain bearing 38 and journal 36 (which acts as a pressure seal), will be drained through the central shaft bore 60, diametral bore 62, clearance 64, and drain conduit 66 defined in the housing end cap 68 to a drain.

A uniform running clearance will accordingly be maintained between the relatively movable parts to assure minimum wear.

The overlapping and mating portions of the rotor member 10 and sleeve member 32 also establish a journal and plain bearing to help maintain the precise orientation of the axis of the shaft.

The rotor 10 end which matingly engages the stator 18 is conventionally defined by a plurality (three for example) of equally spaced voussoirshaped surfaces 17 which are separated by chamfered channels 19 extending radially from the rotor central bore 16 to the outer periphery of the rotor.

Figure 3:
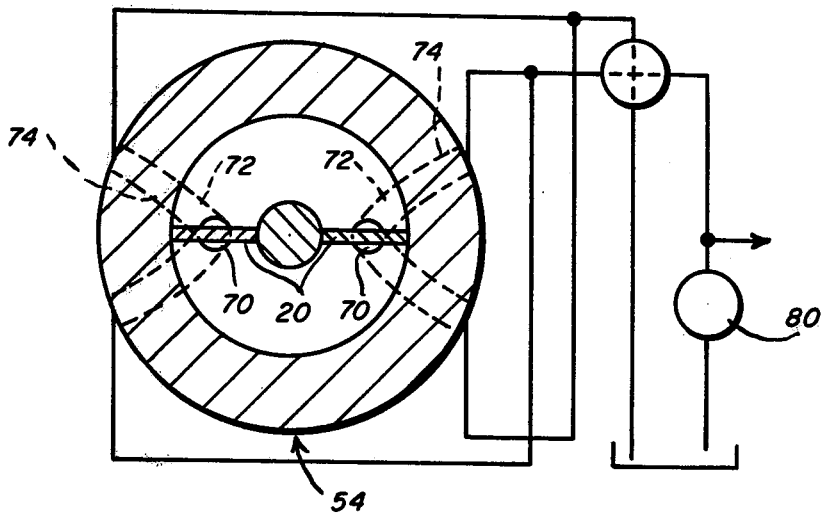
FIG. 3 is a hydraulic circuit diagram for the motor illustrated in FIGS. 1 and 2.

Conventionally, a small bore 70 (FIG. 3) extends a short distance axially from the end of the stator at the center of each slot 22 and obliquely extending conduits 72 which communicate with the outer periphery of the stator, communicate with each of these bores on either side of the blade elements 20. Four radial conduits 74 defined in the housing 54, establish with the stator conduits 72 and the axial bores 70, fluid flow paths from a source 80 of pressurized liquid to the rotor member. A reversing valve selectively controls the flow of pressurized fluid to intake hydraulic chambers defined by the blade members, the drive shaft, the housing, and the chamfered channels, either through the two flow paths on the clockwise side of the blade members to drive the rotor in the clockwise direction or through the two flow paths on the counterclockwise side of the blade members to drive the rotor in the counterclockwise direction. The fluid returns to the source from the adjacent exhaust hydraulic chambers through the other two flow paths.

What I claim is:

1. A hydraulic motor comprising a cylindrical rotor including a central bore, a cylindrical stator including selectively advanceable blade means, said stator having a central bore and first conduit means for directing pressurized fluid to said blade means, a drive shaft extending through said rotor central bore, said drive shaft secured to said rotor, a conical bearing secured to said drive shaft, a bearing track, a cylindrical sleeve member secured within said stator central bore and extending into said rotor central bore and establishing with said rotor central bore a first journal bearing, said drive shaft at the free end thereof establishing with a corresponding segment of said sleeve, a second journal bearing, the internal diameter of the remaining segment of said sleeve being enlarged to define with the corresponding segment of said drive shaft an annular fluid cavity, second conduit means connecting said first conduit means and said cavity.

2. A hydraulic motor according to claim 1, wherein said drive shaft includes a full diameter portion and a reduced diameter section extending from an axial location within said rotor member into said stator member central bore, a segment of said reduced diameter portion, at the free end thereof establishing with said cylindrical sleeve said second journal bearing.

3. A hydraulic motor according to claim 2, wherein said cylindrical sleeve member extends into said rotor central bore to an axial location spaced from said full diameter drive shaft portion.

* * * * *